US005416294A

United States Patent [19]

Glenn

[11] Patent Number: 5,416,294

[45] Date of Patent: May 16, 1995

[54] GAS-FLOW OPERATED SWITCH

[75] Inventor: Brian J. Glenn, Burlington, Conn.

[73] Assignee: Imo Industries, Inc., Lawrenceville, N.J.

[21] Appl. No.: 95,168

[22] Filed: Jul. 21, 1993

[51] Int. Cl.[6] ..... H01H 35/38

[52] U.S. Cl. ..... 200/81.9 M; 73/745; 200/82 E

[58] Field of Search ..... 335/205; 307/118; 73/239, 516 R, 239, 249, 745; 340/606, 611, 626; 200/81.9 R, 81.9 M, 82 R, 82 E

[56] References Cited

U.S. PATENT DOCUMENTS

| | | | |
|---|---|---|---|
| 3,421,124 | 1/1969 | Kidd | 335/205 |
| 4,081,635 | 3/1978 | Moore | 200/81.9 M |
| 4,168,413 | 9/1974 | Halpine | 200/82 E |
| 4,313,111 | 1/1982 | Anderson | 340/606 |

FOREIGN PATENT DOCUMENTS

| | | | |
|---|---|---|---|
| 1282353 | 7/1972 | United Kingdom | 200/81.9 M |

*Primary Examiner*—Gerald P. Tolin

*Attorney, Agent, or Firm*—Hopgood, Calimafde, Kalil & Judlowe

[57] ABSTRACT

A gas-flow sensor features delayed-action response to physical changes in gases as they flow through the sensor, thus avoiding transient flow-metering displacements in response to such change. The delayed-action response is attributable to blind hole and blind-bore configurations within which cylindrical plunger elements must displace in the course of changing gas flow, and the delayed-action response is controlled by provision of predetermined clearances between parts that telescope in the course of sensor operation.

8 Claims, 1 Drawing Sheet

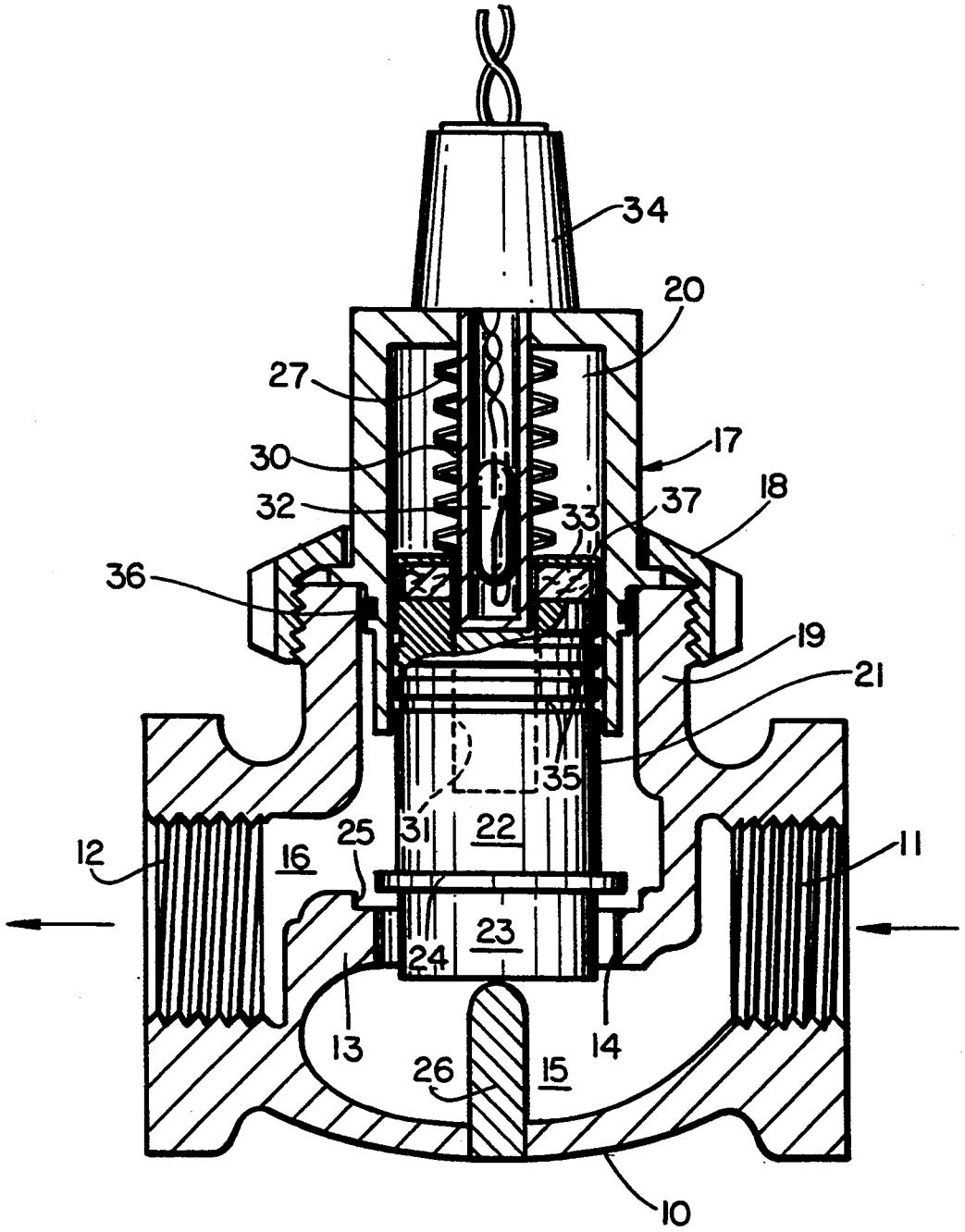
34
20
27
17
30
18
32
37
33
36
19
21
35
31
22
12
25
16
11
23
24
13
14
26
15
10

GAS-FLOW OPERATED SWITCH

BACKGROUND OF THE INVENTION

The invention relates to provision of an economical shuttle-type flow sensor capable of monitoring threshold flows of gases at high-volume flow rates.

Flow sensors presently used to monitor gas flows are either expensive because of their complexity or inaccurate and failure-prone, because of their inability to perform controllably in the unstable environment associated with the compressibility of gases.

On the other hand, in the relatively incompressible environment of liquids, flow switches such as the FS-200 and FS-400 series devices of Gems Sensors Division of Imo Industries, Inc., Plainville, Conn. provide monitored liquid flow with accurate repeatability. The construction of such devices may utilize a valve body, with provision for accommodating the displacement of a magnet-equipped shuttle, as flow increases to a predetermined set point at which a hermetically sealed reed switch is actuated to produce an output signal, as by having the actuated reed switch operate a remote alarm or indicator, or by integrating the reed switch into an automatic system control. But the liquid-flow capability of such a flow switch has been a limiting factor, rendering the same incapable of serving flow-switch purposes in a gas-flow environment.

BRIEF STATEMENT OF THE INVENTION

It is an object of the invention to provide an improved flow-switch construction that is particularly adapted to the reliable monitoring of gas flows.

A specific: object is to achieve the above object with a construction generally adopted from a liquid-flow switch configuration but embodying provision for reliable operation in the unstable environment of gas flows at high volume flow rates.

Another specific object is to provide a flow-switch construction which is characterized by stable and reliable operation in a high-volume gas-flow environment.

The invention achieves these objects in a construction wherein dashpot action is embodied in a gas-flow sensor and wherein a magnet-equipped shuttle coacts with a hermetically sealed reed switch at a set point for signalling detection of a predetermined limiting gas-flow condition. The construction provides features which accommodate physical changes which occur in gases as they flow through the sensor. Operation is characterized by repeatable accuracy, simplicity and economy.

DESCRIPTION OF THE DRAWING

The invention will be described in detail for a preferred embodiment, in conjunction with the accompanying drawing which is a view in vertical section through the displacement axis of the movable element of a flow switch of the invention.

DETAILED DESCRIPTION

The construction shown in the drawing comprises three principal parts, namely: first, a sensor body 10 having an inlet port 11, an outlet port 12 and an internal bridge 13 having a metering bore 14 and dividing the interior of the body into an inlet chamber 15 and an outlet chamber 16; second, a bonnet 17 held by a nut 18 to an upstanding column formation 19 of body 10 and having a cylindrical bore 20 that is aligned with the axis of the body bore 14; and third, a shuttle 21 having a cylindrical plunger body 22 that is guided for vertical displaceability in the bore 20 of bonnet 17.

The lower end of shuttle 21 is a metering head in the form of a cylindrical portion 23 having substantial radial clearance with the body bore 14 and a short radial flange 24, which, for the unactuated condition shown, has both axial and radial clearance with a short counterbore formation 25 in bridge 13, concentric with body bore 14. A stop 26 forming part of body 10 extends through the inlet chamber 15 to provide a bottom limit of shuttle displacement upon abutment by the measuring head portion 23, the same being normally urged in the direction of stop abutment, by compression-spring means 27 retained within bonnet 17.

A tubular stem 30 mounted to the upper end of bonnet 17 and concentric with bore 20 provides concentric guidance for shuttle (21) displacement, via a blind bore 31 within the shuttle body 22, and a hermetically sealed magnetic-reed switch 32 is fixedly mounted, as by suitable potting (not shown) in the bore of stem 30. Switch 32 may be of SPST or of SPDT variety, but in any event switch 32 will be understood to actuate with change of switched state when an annular permanent magnet 33 carried at the upper end of plunger 22 becomes sufficiently close to the reed structure of switch 32. A terminal cap 34 atop bonnet 17 provides external electric-lead connection for the terminals of switch 32.

Description of the structure of the drawing is completed by pointing out that the bonnet stem 30 in telescoping-lap relation with the plunger bore 31 provides primary concentric guidance for shuttle (21) displacement, thus assuring the existence of what may be termed a "bleed" clearance between plunger 22 and the bore 20 of the bonnet. In addition, an axially spaced succession of shallow circumferential grooves, as at 35, in plunger 22 is always lapped by the bore 20 of the bonnet 17. Finally, an elastomeric O-ring 36 seals the fit of bonnet 17 to the column formation 19 of body 10. And a cylindrical cap 37 houses the ring magnet 33.

It will be understood that the metering portion 23 of the metering head will have been turned to a diameter providing a calculated or predetermined circumferential clearance between it and the metering bore 14 of the sensor body. This clearance in conjunction with the force of spring 27 on the shuttle allows below-threshold flows of gas to pass through the sensor without associated switching. As flow increases to threshold set point, force applied normal to the face of the metering-head portion 23 is sufficient to lift the entire shuttle through the body-metering bore 14. In turn, the magnet 33 housed in or otherwise carried in the plunger body 22 of the shuttle is translated along the bonnet stem 30 and causes a reed-switch change of state. The compression spring 27 acting on the shuttle provides requisite force to return the shuttle as flow decreases.

As shuttle displacement proceeds in response to increasing flow, escape of the gas contained in the upper bonnet chamber (within bore 20) is progressively restricted; in the course of this displacement the closed end of bonnet stem 30 contributes to the delay by compressing the volume of gas in the blind hole 31. An inverted condition in this upper chamber results when shuttle displacement is reversed under decreasing flow through the sensor. This performance is achieved through precise fits between bonnet and shuttle components and by the series of pressure drops associated with the grooves 35 in the outer surface of the shuttle plunger body 22.

The restrictive exchange of gas to and from the bonnet chamber (20) above the shuttle plunger body 22 effects delays in shuttle response to those changes in gas density which result from the shuttle metering face exiting and entering the body metering bore 14. The delay allows the changing gas density within the sensor body to equalize across the metering bore before shuttle-displacement response thereto. As a result, the rapid uncontrolled shuttle cycling that would otherwise occur (i.e., without the indicated delay action) is avoided.

One of the manufacturing and economic conveniences of the described gas-flow sensor is the fact, which is preferred, that the sensor may be built into a standard "globe-valve" body 10, with minor modification for gas-flow sensing. The coacting configurations of the bonnet 17 and of the shuttle define an upper chamber which is used to govern shuttle-displacement response to transient density changes in the sensed gas as it passes through the sensor. The configuration differs from that of a liquid-flow sensor, by providing for the blind hole 31 whereby all delay action and coaction is contained within the subassembly of the major shuttle and bonnet components; in a liquid-flow switch, of the type initially indicated above, the bonnet stem which contains a magnetic-reed switch must extend all the way through the shuttle, for lower-end stabilizing action via a grip ring below the metering head. The liquid-flow switch therefore does not have the blind hole which, in the present case, enables the delay action that avoids the rapid uncontrolled shuttle cycling which would otherwise be encountered.

Although the invention has been described in the context of a flow-switch sensor that is to provide an electric-circuit closing (or opening) whereby to signal occurrence of a predetermined upper threshold of gas flow rate, it will be understood that principles of the invention are operable for other kinds of threshold. For example, for a lower measuring-head elevation at which a lower placement of a reed switch is actuable, the signal produced or available upon switch actuation may be indicative of a low-flow or minimum gas-flow condition, failure of which may call for automatic shut-down of a given system. 0r alternatively, as long as the blind hole in the shuttle is deep enough, it will be possible to mount two or more magnetic-reed switches in the blind hole, one above the other, thereby enabling successive thresholds of measuring-head elevation (i.e., gas-flow rate) to be electrically identified, for remote-indicating or system-control purposes. In all cases, however, it is important that the bore 31 which accommodates the one or more reed switches shall be a blind hole, so that the described "delay" feature of the invention can be operative at all times, for conditions of increasing gas-flow rate, as well as for conditions of diminishing gas-flow rate.

What is claimed is:

1. A gas-flow sensor, comprising a main body having inlet and outlet ports and internal bridge structure dividing the interior of said body into an inlet chamber and an outlet chamber, said bridge structure having a flow-metering bore about an axis of metering displaceability, a bonnet having an elongate cylindrical bore communicating with the outlet chamber and centered on the axis of metering displaceability, said bonnet having a closed upper end and mounting a tubular stem on said axis and within the cylindrical bore, a magnetic-reed switch contained by said stem, a shuttle having an upper cylindrical surface in first running clearance with the cylindrical bore and having a blind-hole cylindrical bore in second running clearance with said stem, said bonnet establishing with said shuttle an upper-end chamber which directly communicates only with both of said clearances, said shuttle having at its lower end a metering head, stop means in said body for limiting downward displacement of said shuttle to a predetermined initial clearance relation with said flow-metering bore, at least said first running clearance being always of such gas-flow restricting nature between said upper-end chamber and said outlet chamber as to provide dash-pot action in shuttle-displacement response to a change in gas flow through said metering bore, and magnet means carried by said shuttle for actuating coaction with said switch for a condition of predetermined measuring-head displacement above and beyond said initial clearance relation.

2. The gas-flow sensor of claim 1, and including a compressional spring contained within said bonnet and reacting between said shuttle and the closed upper end of said bonnet.

3. The gas-flow sensor of claim 1, in which said magnet is a permanent magnet configured as an annulus concentric with said axis.

4. The gas-flow sensor of claim 1, in which the upper cylindrical surface of said shuttle has at least one circumferentially continuous groove facing the cylindrical bore of said bonnet over the full range of shuttle displaceability.

5. The gas-flow sensor of claim 4, in which said circumferentially continuous groove is one of a spaced plurality of such grooves.

6. The gas-flow sensor of claim 1, in which a stop on said body is poised for such interference with said metering head as to determine an at-rest position short of metering-bore closure.

7. The gas-flow sensor of claim 6, in which said metering head comprises a cylindrical metering portion in substantial radial clearance relation with said metering bore, and a radial-flange portion adjacent the upper end of said cylindrical metering portion, said flange portion having radial and axial clearance with the metering bore, for the at-rest position.

8. A gas-flow sensor, comprising a main body having inlet and outlet ports and internal bridge structure dividing the interior of said body into an inlet chamber and an outlet chamber, said bridge structure having a flow-metering bore about an axis of metering displaceability, a bonnet having an elongate cylindrical bore communicating with the outlet chamber and centered on the axis of metering displaceability, said bonnet having a closed upper end and mounting a tubular stem on said axis and within the cylindrical bore, a magnetic-reed switch contained by said stem, and a shuttle having an upper cylindrical surface in running clearance with the cylindrical bore and having a blind-hole cylindrical bore in running clearance with said stem, said shuttle having at its lower end a metering head in predetermined initial clearance relation with said flow-metering bore, and magnet means carried by said shuttle for actuating coaction with said switch for a condition of predetermined measuring-head displacement above and beyond said initial clearance relation, said bonnet and said shuttle being configured with such close running clearances, to the bonnet bore and to the blind-hole bore, as to establish a dashpot-like delay in metering-head response to a transient change in gas-flow rate or gas density in the course of gas passage between said ports.

* * * * *